US010567879B2

(12) United States Patent
Audfray et al.

(10) Patent No.: US 10,567,879 B2
(45) Date of Patent: Feb. 18, 2020

(54) COMBINED NEAR-FIELD AND FAR-FIELD AUDIO RENDERING AND PLAYBACK

(71) Applicant: Dolby Laboratories Licensing Corporation, San Francisco, CA (US)

(72) Inventors: Remi S. Audfray, San Francisco, CA (US); Nicolas R. Tsingos, San Francisco, CA (US); Pradeep Kumar Govindaraju, Fremont, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/270,544

(22) Filed: Feb. 7, 2019

(65) Prior Publication Data

US 2019/0246209 A1 Aug. 8, 2019

Related U.S. Application Data

(60) Provisional application No. 62/628,096, filed on Feb. 8, 2018.

(30) Foreign Application Priority Data

Feb. 8, 2018 (EP) ..... 18155761

(51) Int. Cl.
*H04S 7/00* (2006.01)
*H04R 5/04* (2006.01)
(Continued)

(52) U.S. Cl.
CPC ..... *H04R 5/04* (2013.01); *H04R 3/12* (2013.01); *H04R 5/033* (2013.01); *H04S 7/304* (2013.01)

(58) Field of Classification Search
CPC .. H04S 2420/01; H04S 7/302; H04S 2400/13; H04S 5/005; H04S 7/307; H04R 2205/024; H04R 2420/05
See application file for complete search history.

(56) References Cited

U.S. PATENT DOCUMENTS 5,917,916 A 6/1999 Sibbald
9,094,771 B2 7/2015 Tsingos
(Continued)

FOREIGN PATENT DOCUMENTS

EP 2809088 12/2014
EP 2806658 9/2017
WO 2016/183379 12/2016

OTHER PUBLICATIONS

Menzies, Dylan "Nearfield Synthesis of Complex Sources with High-Order Ambisonics, and Binaural Rendering" Proc. of the 13th International Conference on Auditory Display, Montreal, Canada, Jun. 26-29, 2007, pp. 1-8.

(Continued)

*Primary Examiner* — Kile O Blair

(57) ABSTRACT

Some disclosed methods may involve receiving audio reproduction data and determining, based on the audio reproduction data, a sound source location at which a sound is to be rendered. A near-field gain and a far-field gain may be based, at least in part, on a sound source distance between the sound source location and a reproduction environment location. Room speaker feed signals may be based, at least in part, on room speaker positions, the sound source location and the far-field gain. Near-field speaker feed signals may be based, at least in part, on the near-field gain, the sound source location and a position of near-field speakers.

15 Claims, 5 Drawing Sheets

(51) Int. Cl.
*H04R 5/033* (2006.01)
*H04R 3/12* (2006.01)

(56) References Cited

U.S. PATENT DOCUMENTS

| | | | | |
|---|---|---|---|---|
| 9,107,023 | B2 | 8/2015 | Ninan | |
| 2012/0213391 | A1 | 8/2012 | Usami | |
| 2012/0237037 | A1 * | 9/2012 | Ninan | H04S 7/304 381/17 |

OTHER PUBLICATIONS

Lentz, T. et al "Precise Near-to-Head Accoustics with Binaural Synthesis", Journal of Virtual Reality and Broadcasting, vol. 3, 2006, No. 2, pp. 1-12.
Rui, Y. et al "Calculation of Individualized Near-Field Head-Related Transfer Function Database Using Boundary Element Method", Audio Engineering Society Convention Paper 8901, May 4-7, 2013, Rome, Italy, pp. 1-8.
Yu, G. et al "Perceptual Evaluation on the influence of individualized near-field head-related transfer functions on auditory distance localization", The Journal of the Acoustical Society of America, vol. 141, Issue 5, Jun. 2017.
Pulkki, Ville "Compensating Displacement of Amplitude-Panned Virtual Sources" Compensating Virtual Source Displacement, AES 22nd International Conference on Virtual, Synthetic and Entertainment Audio, Section 2, pp. 3-4, Jun. 1, 2002.
118th MPEG Hobart (TAS), Australia, Apr. 3-7, 2017, Meeting Report Panos Kudumakis and Krishna Chandramouli, Meeting Report at p. 3.

* cited by examiner

500

COMBINED NEAR-FIELD AND FAR-FIELD AUDIO RENDERING AND PLAYBACK

CROSS-REFERENCE TO RELATED APPLICATION(S)

This application claims the benefit of priority to U.S. Provisional Patent Application No. 62/628,096 filed Feb. 8, 2018, and European Patent Application No. 18155761.2 filed Feb. 8, 2018, both of which are incorporated herein by reference in their entirety.

TECHNICAL FIELD

This disclosure relates to the processing of audio signals. In particular, this disclosure relates to processing audio signals for a reproduction environment that includes near-field speakers and far-field speakers, such as room loudspeakers.

BACKGROUND

Realistically presenting a virtual environment to a movie audience, to game players, etc., can be challenging. A reproduction environment that includes near-field speakers and far-field speakers can potentially enhance the ability to present realistic sounds for such a virtual environment. For example, near-field speakers may be used to add depth information that may be missing, incomplete or imperceptible when audio data are reproduced via far-field speakers. However, presenting audio via both near-field speakers and far-field speakers can introduce additional complexity and challenges, as compared to presenting audio via only near-field speakers or via only far-field speakers.

SUMMARY

Various audio processing methods are disclosed herein. Some such methods involve receiving audio reproduction data and determining, based on the audio reproduction data, a sound source location, relative to a reproduction environment location, at which a sound is to be rendered. A method may involve determining a sound source distance between the sound source location and the reproduction environment location and determining a near-field gain and a far-field gain based, at least in part, on the sound source distance.

In some examples, the method may involve determining, if the far-field gain is non-zero, a room speaker feed signal for each of a plurality of room speakers within the reproduction environment. Each speaker feed signal may correspond to at least one of the room speakers. Each room speaker feed signal may be based, at least in part, on a room speaker position, the sound source location and the far-field gain.

According to some examples, the method may involve determining a first position corresponding to a first set of near-field speakers located within the reproduction environment. The method may involve determining, if the near-field gain is non-zero, first near-field speaker feed signals based at least in part on the near-field gain, the sound source location and the first position of the first set of near-field speakers. The method may involve providing the near-field speaker feed signals to the first set of near-field speakers, providing the room speaker feed signals to the room speakers, and/or providing both the near-field speaker feed signals to the first set of near-field speakers and the room speaker feed signals to the room speakers.

In some examples, the method may involve determining a first orientation of the first set of near-field speakers. Determining the near-field speaker feed signals may be based, at least in part, on the orientation of the first set of near-field speakers. In some implementations, the first position may correspond to a first position of a user's head and the first orientation may correspond to a first orientation of a user's head.

According to some implementations, the audio reproduction data may include one or more audio objects. The sound source location may be an audio object location. In some examples, the reproduction environment location may correspond with a center of the reproduction environment. According to some examples, the far-field gain may be non-zero if the sound source location is at least a far-field threshold distance from the reproduction environment location.

In some examples, the first set of near-field speakers may be disposed within first headphones. The method may involve determining audio occlusion data for the first headphones. In some instances, the method also may involve equalizing the room speaker feed signals based, at least in part, on the audio occlusion data. In some examples, the method may involve determining an average target equalization for the room speakers and equalizing the first near-field speaker feed signals based, at least in part, on the average target equalization. According to some implementations, the method also may involve transmitting the near-field speaker feed signals to the first set of near-field speakers via a wireless interface.

According to some examples, the method may involve determining a second position of a second set of near-field speakers located within the reproduction environment and determining, if the near-field gain is non-zero, second near-field speaker feed signals based at least in part on the near-field gain and the second position of the second set of near-field speakers. The second near-field speaker feed signals may be different from the first near-field speaker feed signals. In some examples, the method also may involve determining a second orientation of the second set of near-field speakers. Determining the second near-field speaker feed signals may be based, at least in part, on the second orientation.

In some examples, the method also may involve receiving an indication of a user interaction, generating interaction audio data corresponding with the user interaction and generating near-field speaker feed signals based on the interaction audio data. The interaction audio data may include an interaction audio data position.

Some alternative audio processing methods are disclosed herein. One such method involves receiving audio reproduction data and determining, based on the audio reproduction data, a sound source location, relative to a reproduction environment location, at which a sound is to be rendered. The method may involve determining a sound source distance between the sound source location and the reproduction environment location, determining a height difference between the sound source location and a first position of a user's head and determining a near-field gain and a far-field gain based, at least in part, on the sound source distance and the height difference.

In some examples, the method also may involve determining a room speaker feed signal for each of a plurality of room speakers within the reproduction environment. Each speaker feed signal may correspond to at least one of the room speakers. Each room speaker feed signal may be based, at least in part, on a room speaker position, the sound source location and the far-field gain. The method may involve determining first near-field speaker feed signals based at least in part on the near-field gain, the sound source location and the first position of the user's head. The method also may involve providing the near-field speaker feed signals to the first set of near-field speakers and providing the room speaker feed signals to the room speakers.

According to some examples, the reproduction environment location may correspond with a center of the reproduction environment. In some examples, the first position of the user's head may correspond to a first position of a first set of near-field speakers located within the reproduction environment. According to some examples, the method also may involve determining a first orientation of the user's head. Determining the near-field speaker feed signals may be based, at least in part, on the first orientation of the user's head.

In some implementations, the method also may involve determining a high-frequency component of the audio reproduction data. Determining the first near-field speaker feed signals may involve a binaural rendering of the high-frequency component. In some such implementations, the method also may involve determining a low-frequency component of the audio reproduction data. Determining the room speaker feed signals may involve applying the far-field gain to a sum of the low-frequency component and the high-frequency component.

In some examples, the audio reproduction data may include one or more audio objects. The sound source location may be an audio object location.

In some examples, the first set of near-field speakers may be disposed within first headphones. The method may involve determining audio occlusion data for the first headphones. In some instances, the method also may involve equalizing the room speaker feed signals based, at least in part, on the audio occlusion data. In some examples, the method may involve determining an average target equalization for the room speakers and equalizing the first near-field speaker feed signals based, at least in part, on the average target equalization. According to some implementations, the method also may involve transmitting the near-field speaker feed signals to the first set of near-field speakers via a wireless interface.

Some or all of the methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. Accordingly, various innovative aspects of the subject matter described in this disclosure can be implemented in a non-transitory medium having software stored thereon. The software may, for example, include instructions for controlling at least one device to process audio data. The software may, for example, be executable by one or more components of a control system such as those disclosed herein. The software may, for example, include instructions for performing one or more of the methods disclosed herein.

At least some aspects of the present disclosure may be implemented via apparatus. For example, one or more devices may be configured for performing, at least in part, the methods disclosed herein. In some implementations, an apparatus may include an interface system and a control system. The interface system may include one or more network interfaces, one or more interfaces between the control system and a memory system, one or more interfaces between the control system and another device and/or one or more external device interfaces. The control system may include at least one of a general purpose single- or multi-chip processor, a digital signal processor (DSP), an application specific integrated circuit (ASIC), a field programmable gate array (FPGA) or other programmable logic device, discrete gate or transistor logic, or discrete hardware components.

According to some such examples, the apparatus may include an interface system and a control system. The interface system may be configured for receiving audio reproduction data, which may include audio objects. The control system may, for example, be configured for performing, at least in part, one or more of the methods disclosed herein.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DESCRIPTION OF EXAMPLE EMBODIMENTS

The following description is directed to certain implementations for the purposes of describing some innovative aspects of this disclosure, as well as examples of contexts in which these innovative aspects may be implemented. However, the teachings herein can be applied in various different ways. Moreover, the described embodiments may be implemented in a variety of hardware, software, firmware, etc. For example, aspects of the present application may be embodied, at least in part, in an apparatus, a system that includes more than one device, a method, a computer program product, etc. Accordingly, aspects of the present application may take the form of a hardware embodiment, a software embodiment (including firmware, resident software, microcodes, etc.) and/or an embodiment combining both software and hardware aspects. Such embodiments may be referred to herein as a "circuit," a "module" or "engine." Some aspects of the present application may take the form of a computer program product embodied in one or more non-transitory media having computer readable program code embodied thereon. Such non-transitory media may, for example, include a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. Accordingly, the teachings of this disclosure are not intended to be limited to the implementations shown in the figures and/or described herein, but instead have wide applicability.

Figure 1:
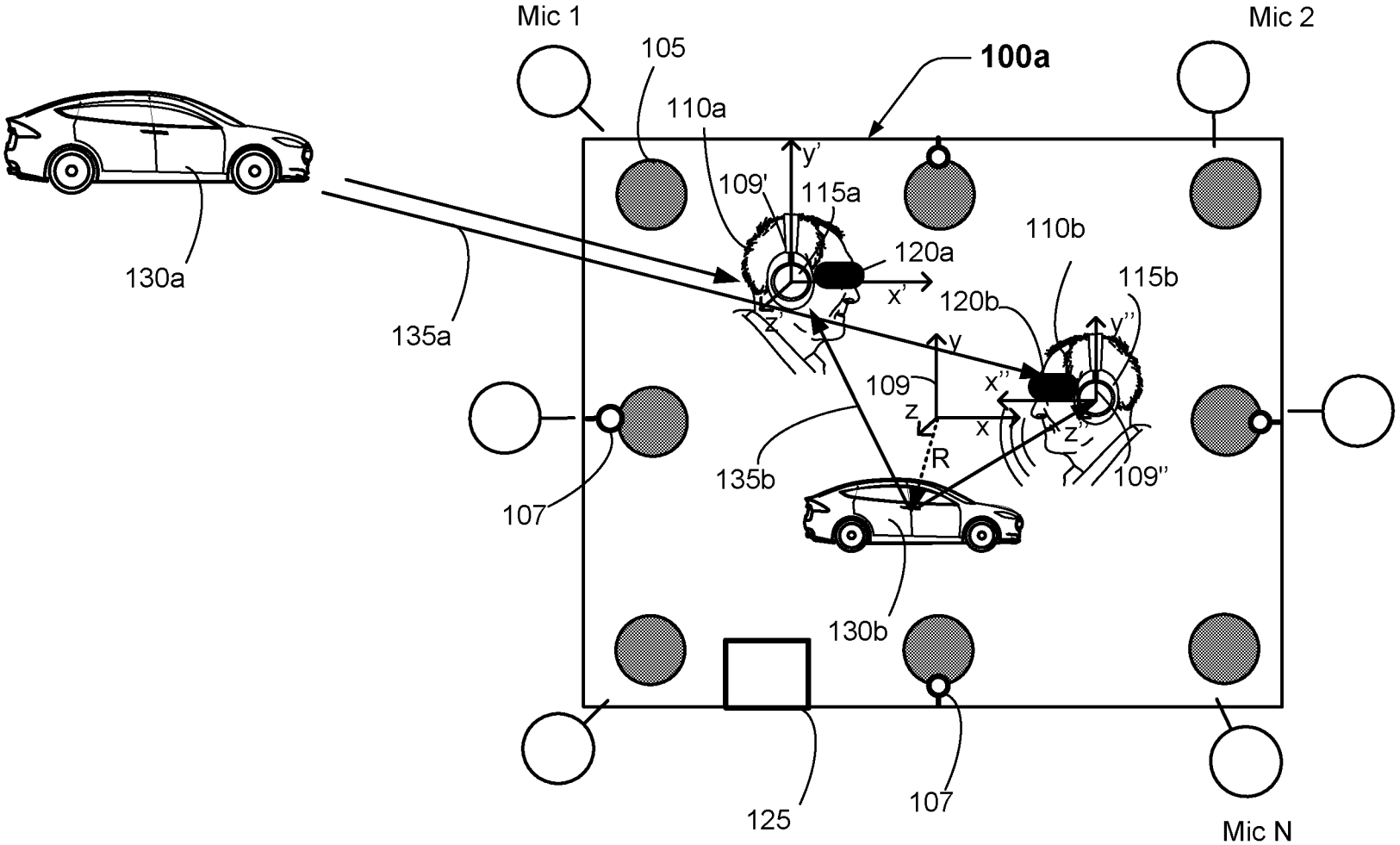
FIG. 1 shows examples of different sound sources in a reproduction environment.

FIG. 1 shows examples of different sound sources in a reproduction environment. As with other implementations shown and described herein, the numbers and kinds of elements shown in FIG. 1 are merely presented by way of example. According to this implementation, room speakers 105 are positioned in various locations of the reproduction environment 100*a*.

Here, the players 110*a* and 110*b* are wearing headphones 115*a* and 115*b*, respectively, while playing a game. According to this example, the players 110*a* and 110*b* are also wearing virtual reality (VR) headsets 120*a* and 120*b*, respectively, while playing the game. In this implementation, the audio and visual aspects of the game are being controlled by the personal computer 125. In some examples, the personal computer 125 may provide the game based, at least in part, on instructions, data, etc., received from one or more other devices, such as a game server. The personal computer 125 may include a control system and an interface system such as those described elsewhere herein.

In this example, the audio and video effects being presented for the game include audio and video representations of the cars 130*a* and 130*b*. The car 130*a* is outside the reproduction environment, so the audio corresponding to the car 130*a* may be presented to the players 110*a* and 110*b* via room speakers 105. This is true in part because "far-field" sounds, such as the direct sounds 135*a* from the car 130*a*, seem to be coming from a similar direction from the perspective of the players 110*a* and 110*b*. If the car 130*a* were located at a greater distance from the reproduction environment 100*a*, the direct sounds 135*a* from the car 130*a* would seem, from the perspective of the players 110*a* and 110*b*, to be coming from approximately the same direction.

However, "near-field" sounds, such as the direct sounds 135*b* from the car 130*b*, cannot always be reproduced realistically by the room speakers 105. In this example, the direct sounds 135*b* from the car 130*b* appear to be coming from different directions, from the perspective of each player. Therefore, such near-field sounds may be more accurately and consistently reproduced by headphone speakers or other types of near-field speakers, such as those that may be provided on some VR headsets.

Some implementations may involve monitoring player locations and head orientations in order to provide audio to the near-field speakers in which sounds are accurately rendered according to intended sound source locations. In this example, the reproduction environment 100*a* includes cameras 107 that are configured to provide image data to a personal computer or other local device. Player locations and head orientations may be determined from the image data. According to some implementations, the position and orientation of a set of near-field speakers may be inferred according to the position and orientation of a player's head. However, in some examples, the location and orientation of headsets, headphones and/or other devices in which near-field speakers may be deployed may be determined directly according to image data from the cameras 107. Alternatively, or additionally, in some implementations headsets, headphones, or other wearable gear may include one or more inertial sensor devices that are configured for providing information regarding player head orientation and/or player location.

In some examples, a sound source location, the location and orientation of a player's head, the location and orientation of headsets, headphones and/or other devices may be determined relative to one or more coordinate systems. At least one coordinate system may, in some examples, have its origin the reproduction environment 100*a*. In the example shown in FIG. 1, the positions of sound source locations, etc., may be determined relative to the coordinate system 109, which has its origin in the center of the reproduction environment 100*a*. According to this example, a sound source location corresponding with the car 130*b* is at a radius R relative to the origin of the coordinate system 109.

Although the coordinate system 109 is a Cartesian coordinate system, other implementations may involve determining locations according to a cylindrical coordinate system, a spherical coordinate system, or another coordinate system. Alternative implementations may have the origin in the center of the reproduction environment 100*a* or in another location. According to some implementations, the origin location may be user-selectable. For example, a user may be able to interact with a user interface of a mobile device, of the personal computer 125, etc., to select a location of the origin of the coordinate system 109, such as the location of the user's head. Such implementations may be advantageous for single-player scenarios in which the user is not significantly changing his or her location during the course of a game.

In the example shown in FIG. 1, however, there are two players. Each of the players 110*a* and 110*b* may move during the course of the game. Accordingly, both the position and the orientation of each player's head may change. As noted above, the location and orientation of the player's heads, of the player's headsets, headphones and/or other devices in which near-field speakers may be deployed may be determined according to image data from the cameras 107, according to inertial sensor data and/or according to other methods known by those of skill in the art. For example, in some implementations the location and orientation of the player's heads, of the player's headsets, etc., may be determined according to a head tracking system. The head tracking system may, for example, be an optical head tracking system such as one of the TrackIR infrared head tracking systems that are provided by Natural Point™, a head tracking system such as those provided by TrackHat™, a head tracking system such as those provided by DelanClip™, etc.

In order to properly render near-field audio from the players' perspectives, it can be advantageous to establish coordinate systems relative to each player's head, relative to each player's near-field speakers, etc. According to this example, coordinate system 109' has been established relative to the headphones 115*a* and coordinate system 109" has been established relative to the headphones 115*b*. In some examples, near-field and far-field gains may be determined with reference to the coordinate system 109. However, according to some implementations, near-field speaker feed signals for the headphones 115*a* may be determined with reference to the coordinate system 109' and near-field speaker feed signals for the headphones 115*b* may be determined with reference to the coordinate system 109". Some such examples may involve making a coordinate transformation between the coordinate system 109 and the coordinate systems 109' and 109". Alternatively, some implementations may involve determining far-field gains with reference to the coordinate system 109 and determining separate near-field gains with reference to the coordinate systems 109' and 109".

According to some implementations, at least some sounds that are reproduced by near-field speakers, such as near-field game sounds, may not be reproduced by room speakers.

Similarly, in some examples at least some far-field sounds that are reproduced by room speakers may not be reproduced by near-field speakers. There may also be instances in which it is not possible for room speakers, or another type of far-field speaker system, to reproduce sound that is intended to be reproduced by the far-field speaker system. For example, there may not be a room speaker in the proper location for reproducing sound from a particular direction, e.g., from the floor of a reproduction environment. In some such examples, audio signals that cannot be properly reproduced by the room speakers may be redirected to near-field speaker system.

Figure 2:
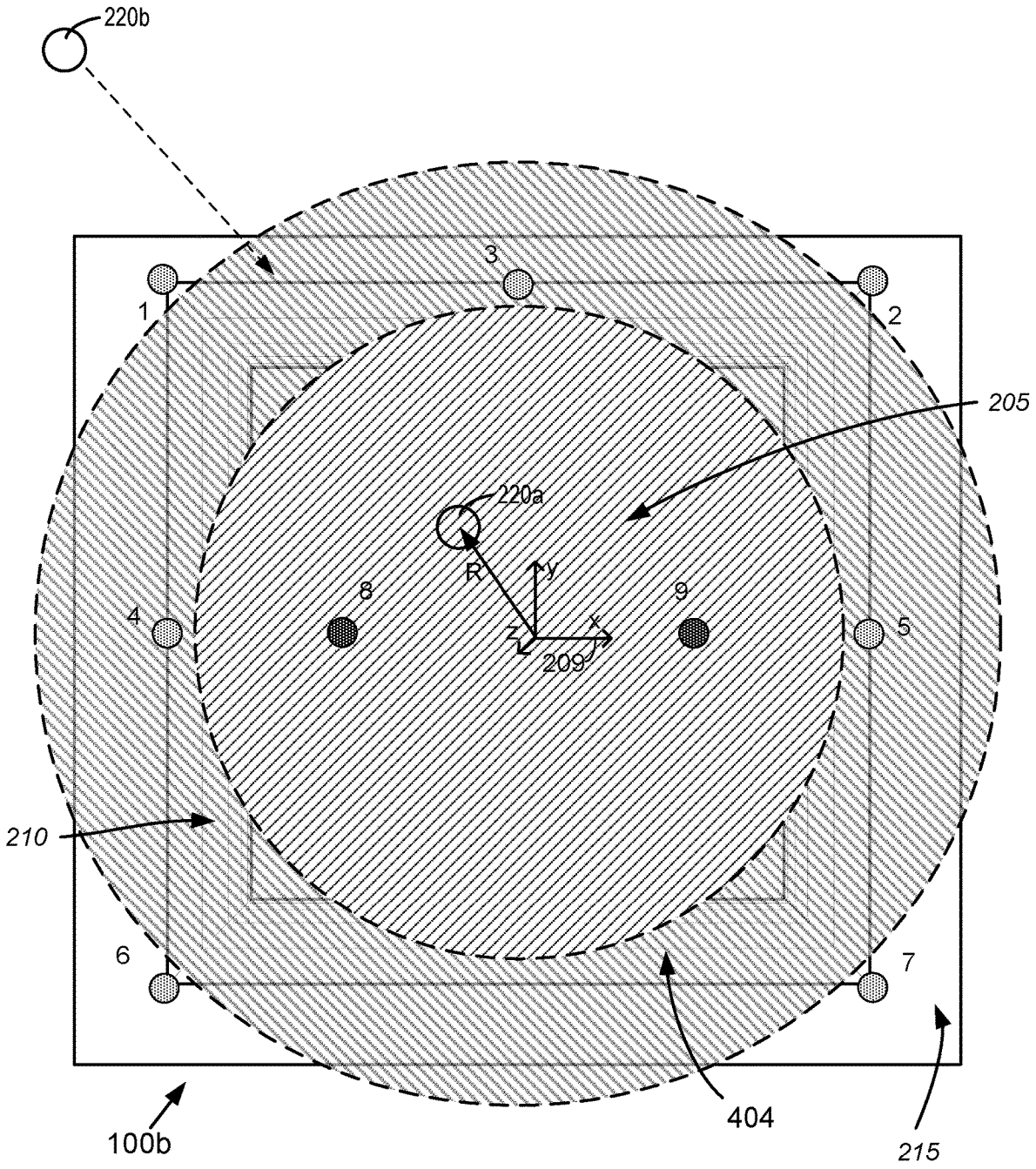
FIG. 2 shows an example of a top view of a reproduction environment.

FIG. 2 shows an example of a top view of a reproduction environment. FIG. 2 also shows examples of near-field, far-field and transitional zones of the reproduction environment 100*b*. The sizes, shapes and extent of these zones are merely made by way of example. Here, the reproduction environment 100*b* includes room speakers 1-9. In this example, near-field panning methods are applied for audio objects located within zone 205, transitional panning methods are applied for audio objects located within zone 210 and far-field panning methods are applied for audio objects located in zone 215, outside of zone 210.

In the example shown in FIG. 2, the positions of sound source locations, etc., are determined relative to the coordinate system 209, which has its origin in the center of the reproduction environment 100*b*. According to this example, the audio object 220*a* is at a radius R relative to the origin of the coordinate system 209.

According to this example, the near-field panning methods involve rendering near-field audio objects located within zone 205 (such as the audio object 220*a*) into speaker feed signals for near-field speakers, such as headphone speakers, speakers of a virtual reality headset, etc., as described elsewhere herein. According to some such examples, near-field speaker feed signals may be determined according to the position and/or orientation of a user's head or of the near-field speakers themselves. As noted above, this may involve determining different near-field speaker feed signals for each user or player, e.g., according to a coordinate system associated with each person or player. According to some examples, no far-field speaker feed signals will be determined for sound sources located within the zone 205.

In this implementation, far-field panning methods are applied for audio objects located in zone 215, such as the audio object 220*b*. According to some examples, no near-field speaker feed signals will be determined for sound sources located outside of the zone 210. In some examples, the far-field panning methods may be based on vector-based amplitude panning (VBAP) equations that are known by those of ordinary skill in the art. For example, the far-field panning methods may be based on the VBAP equations described in Section 2.3, page 4 of V. Pulkki, Compensating Displacement of Amplitude-Panned Virtual Sources (AES International Conference on Virtual, Synthetic and Entertainment Audio), which is hereby incorporated by reference. In alternative implementations, other methods may be used for panning far-field audio objects, e.g., methods that involve the synthesis of corresponding acoustic planes or spherical waves. D. de Vries, Wave Field Synthesis (AES Monograph 1999), which is hereby incorporated by reference, describes relevant methods.

It may be desirable to blend between different panning modes as an audio object enters or leaves the virtual reproduction environment 100*b*, e.g., if the audio object 220*b* moves into zone 210 as indicated by the arrow in FIG. 2. In some examples, a blend of gains computed according to near-field panning methods and far-field panning methods may be applied for audio objects located in zone 210. In some implementations, a pair-wise panning law (e.g., an energy-preserving sine or power law) may be used to blend between the gains computed according to near-field panning methods and far-field panning methods. In alternative implementations, the pair-wise panning law may be amplitude-preserving rather than energy-preserving, such that the sum equals one instead of the sum of the squares being equal to one. In some implementations, the audio signals may be processed by applying both near-field and far-field panning methods independently and cross-fading the two resulting audio signals.

Figure 3:
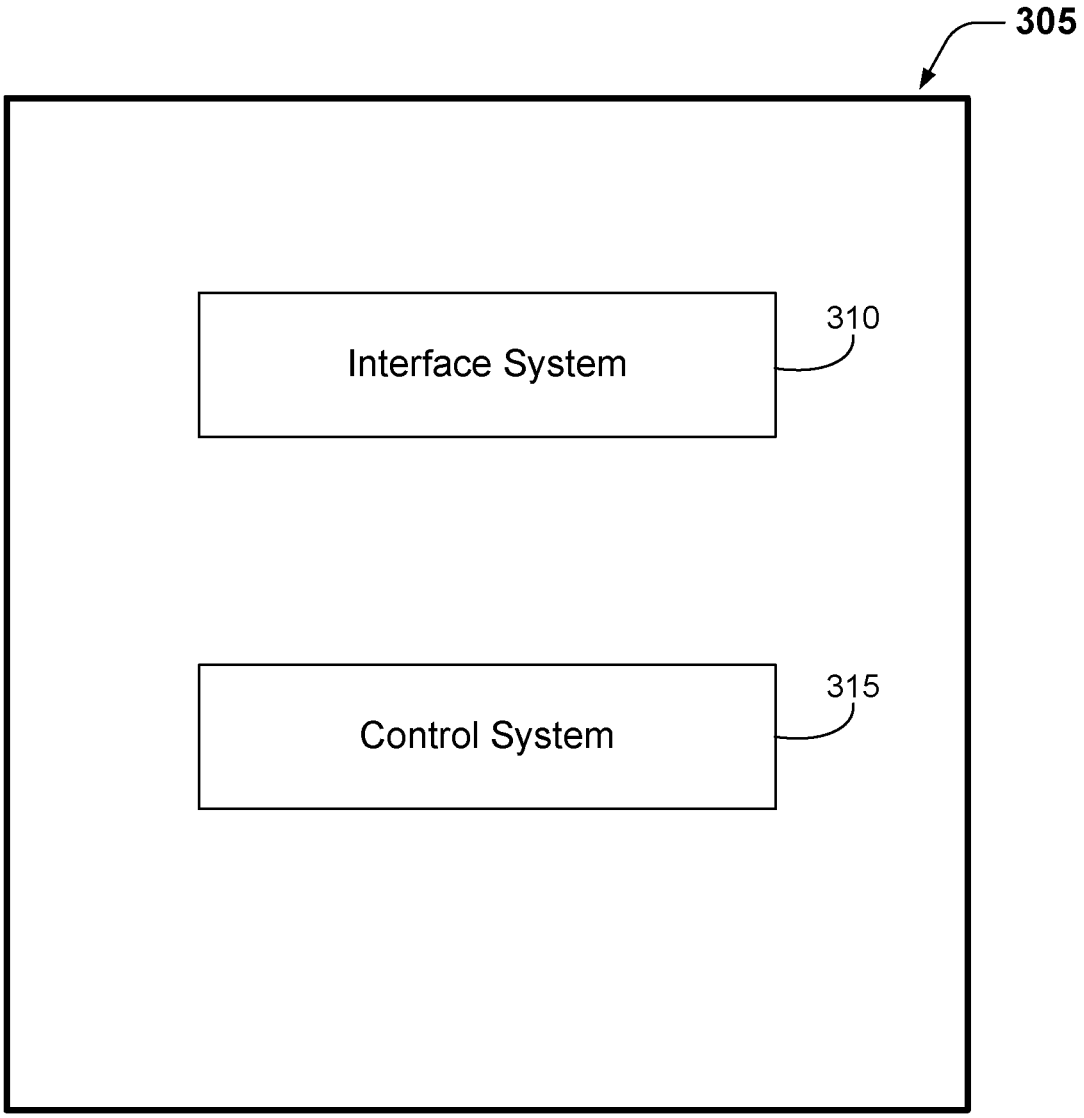
FIG. 3 is a block diagram that shows examples of components of an apparatus that may be configured to perform at least some of the methods disclosed herein.

FIG. 3 is a block diagram that shows examples of components of an apparatus that may be configured to perform at least some of the methods disclosed herein. In some examples, the apparatus 305 may be a personal computer (such as the personal computer 125 described above) or other local device that is configured to provide audio processing for a reproduction environment. According to some examples, the apparatus 305 may be a client device that is configured for communication with a server, such as a game server, via a network interface. The components of the apparatus 305 may be implemented via hardware, via software stored on non-transitory media, via firmware and/or by combinations thereof. The types and numbers of components shown in FIG. 3, as well as other figures disclosed herein, are merely shown by way of example. Alternative implementations may include more, fewer and/or different components.

In this example, the apparatus 305 includes an interface system 310 and a control system 315. The interface system 310 may include one or more network interfaces, one or more interfaces between the control system 315 and a memory system and/or one or more external device interfaces (such as one or more universal serial bus (USB) interfaces). In some implementations, the interface system 310 may include a user interface system. The user interface system may be configured for receiving input from a user. In some implementations, the user interface system may be configured for providing feedback to a user. For example, the user interface system may include one or more displays with corresponding touch and/or gesture detection systems. In some examples, the user interface system may include one or more microphones and/or speakers. According to some examples, the user interface system may include apparatus for providing haptic feedback, such as a motor, a vibrator, etc. The control system 315 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components.

In some examples, the apparatus 305 may be implemented in a single device. However, in some implementations, the apparatus 305 may be implemented in more than one device. In some such implementations, functionality of the control system 315 may be included in more than one device. In some examples, the apparatus 305 may be a component of another device.

Figure 4:
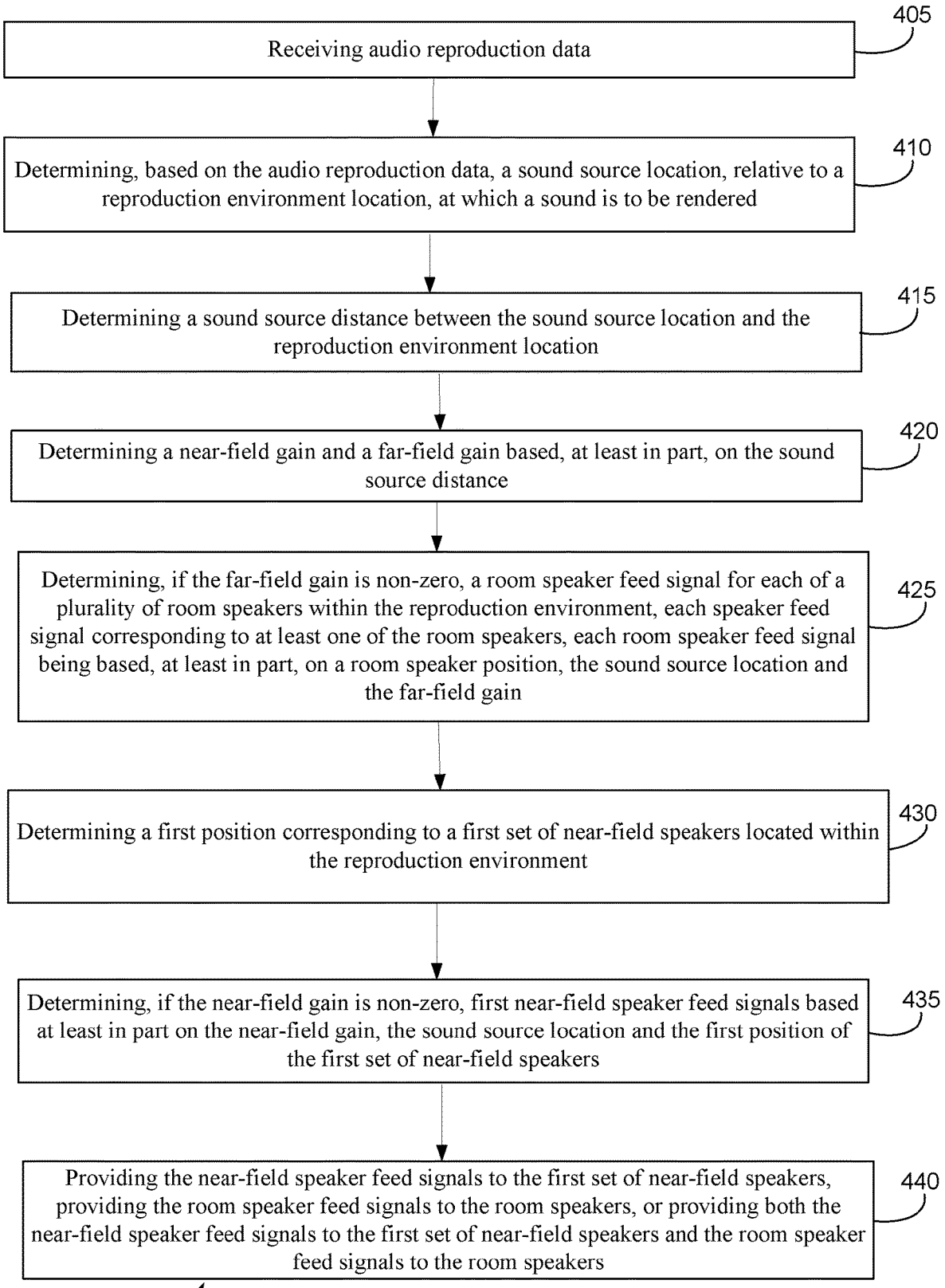
FIG. 4 is a flow diagram that outlines blocks of a method according to one example.

FIG. 4 is a flow diagram that outlines blocks of a method according to one example. The method may, in some instances, be performed by the apparatus of FIG. 3 or by another type of apparatus disclosed herein. In some examples, the blocks of method 400 may be implemented via software stored on one or more non-transitory media. The blocks of method 400, like other methods described herein, are not necessarily performed in the order indicated. Moreover, such methods may include more or fewer blocks than shown and/or described.

In this implementation, block 405 involves receiving audio reproduction data. According to some examples, the audio reproduction data may include audio objects. The audio objects may include audio data and associated metadata. The metadata may, for example, include data indicating the position, size, directivity and/or trajectory of an audio object in a three-dimensional space, etc. Alternatively, or additionally, the audio reproduction data may include channel-based audio data.

According to this example, block 410 involves determining, based on the audio reproduction data, a sound source location, relative to a reproduction environment location, at which a sound is to be rendered. Here, block 415 involves determining a sound source distance between the sound source location and the reproduction environment location. For example, the reproduction environment location may be the origin of a coordinate system. In such instances, the sound source distance may correspond with a radius from the origin of the coordinate system to the sound source location. In some examples, the reproduction environment location may correspond with a center of the reproduction environment. For implementations in which the audio reproduction data includes audio objects, the sound source location may correspond with an audio object location. In some such instances, the sound source distance may correspond with a radius from the origin of the coordinate system to the audio object location.

In this example, block 420 involves determining a near-field gain and a far-field gain based, at least in part, on the sound source distance. Some detailed examples are provided below. According to some examples, block 420 (or another block of the method 400) may involve differentiating near-field sound sources and far-field sound sources in the audio reproduction data. Block 420 may, for example, involve differentiating the near-field sound sources and the far-field sound sources according to a distance between the sound source location and the location of the reproduction environment, such as an origin of a coordinate system. For example, block 420 may involve determining whether a location at which a sound source is to be rendered is within a predetermined first radius of a point, such as a center point, of the reproduction environment.

According to some examples, block 420 may involve determining that a sound source is to be rendered in a transitional zone between the near field and the far field. The transitional zone may, for example, correspond to a zone outside of the first radius but less than or equal to a predetermined second radius of a point, such as a center point, of the reproduction environment. In some implementations, sound sources may include metadata indicating whether a sound source is a near-field sound source, a far-field sound source or in a transitional zone between the near field and the far field. Some examples are described above with reference to FIG. 2. A sound source can also be directed to a single room speaker or a set of room speakers. This may or may not be dependent on audio source position and/or speaker layout. For example, the sound source may correspond with low-frequency effects.

In this example, block 425 involves determining, if the far-field gain is non-zero, a room speaker feed signal for each of a plurality of room speakers within the reproduction environment. According to some examples, the far-field gain may be non-zero if the sound source location is at least a far-field threshold distance from the reproduction environment location. According to this example, each speaker feed signal corresponds to at least one of the room speakers. Here, each room speaker feed signal is based, at least in part, on a room speaker position, the sound source location and the far-field gain.

According to some examples, block 425 may involve rendering far-field audio objects into a first plurality of speaker feed signals for room speakers of a reproduction environment. Each speaker feed signal may, for example, correspond to at least one of the room speakers. According to some such implementations, block 425 may involve computing audio gains and speaker feed signals for the reproduction environment based on received audio data and associated metadata. Such audio gains and speaker feed signals may, for example, be computed according to an amplitude panning process, which can create a perception that a sound is coming from a position P in, or in the vicinity of, the reproduction environment. For example, speaker feed signals may be provided to reproduction speakers 1 through N of a reproduction environment according to the following equation:

$$x_i(t)=g_i x(t), i=1, \ldots N \quad \text{(Equation 1)}$$

In Equation 1, $x_i(t)$ represents the speaker feed signal to be applied to speaker i, $g_i$ represents the gain factor of the corresponding channel, x(t) represents the audio signal and t represents time. The gain factors may be determined, for example, according to the amplitude panning methods described in Section 2, pages 3-4 of V. Pulkki, *Compensating Displacement of Amplitude-Panned Virtual Sources* (Audio Engineering Society (AES) International Conference on Virtual, Synthetic and Entertainment Audio), which is hereby incorporated by reference. In some implementations, at least some of the gains may be frequency dependent. In some implementations, a time delay may be introduced by replacing x(t) by x(t−Δt).

According to the example shown in FIG. 4, block 430 involves determining a first position corresponding to a first set of near-field speakers located within the reproduction environment. In some implementations, block 430 may involve determining a position of a person's head. For example, the reproduction environment may include one or more cameras that are configured to provide image data to a personal computer or other local device. The location—and in some instances the orientation—of a person's head may be determined from the image data. According to some implementations, the position and orientation of a set of near-field speakers may be inferred according to the position and orientation of a player's head. In some examples, the location and orientation of headsets, headphones and/or other devices in which near-field speakers may be deployed may be determined directly according to image data from the cameras. Alternatively, or additionally, in some implementations headsets, headphones, or other wearable gear may include one or more inertial sensor devices that are configured for providing information regarding player head orientation and/or player location. Referring to the example of FIG. 1, block 430 may involve determining the location and orientation of the head of the player 110*a*, the location and orientation of the headphones 115*a*, etc. In some implementations, block 430 may involve determining the location of the origin of the coordinate system 109' and the orientation of the coordinate system 109' relative to the coordinate system 109.

In this example, block 435 involves determining, if the near-field gain is non-zero, first near-field speaker feed signals based at least in part on the near-field gain, the sound source location and the first position of the first set of near-field speakers. As noted above, some implementations may involve determining a first orientation of the first set of near-field speakers. According to some such implementations, determining the near-field speaker feed signals may be based, at least in part, on the orientation of the first set of near-field speakers. In some such implementations, the first position may correspond to a first position of a user's head and the first orientation may correspond to a first orientation of a user's head.

In some implementations, block 435 may involve rendering near-field audio objects into speaker feed signals for near-field speakers of the reproduction environment. Headphone speakers may, in this disclosure, be referred to as a particular category of near-field speakers. In some examples, block 435 may proceed substantially like the processes of block 425.

However, block 435 also may involve determining the first near-field speaker feed signals based on the location (and in some examples the orientation) of the near-field speakers, in order to render the near-field audio objects in the proper locations from the perspective of a user whose location and head orientation may change over time. Referring to the example of FIG. 1, block 435 may involve determining near-field speaker feed signals for the headphones 115*a* based, at least in part, on the location of the origin of the coordinate system 109' and the orientation of the coordinate system 109' relative to the coordinate system 109. In some such examples, block 435 may involve a coordinate transformation between the coordinate system 109 and the coordinate system 109'. According to some examples, block 435 (or another block of method 400) may involve additional processing, such as binaural or transaural processing of near-field sounds, in order to provide improved spatial audio cues.

According to this example, block 440 involves providing the near-field speaker feed signals to the first set of near-field speakers (e.g., to the headphones 115*a* of FIG. 1) and/or providing the room speaker feed signals to the room speakers (e.g., to the room speakers 105 of FIG. 1). In some implementations block 440 may involve transmitting the near-field speaker feed signals to the first set of near-field speakers via a wireless interface. For example, the personal computer 125 and the headphones 115*a* of FIG. 1 may include wireless interfaces. Block 440 may involve the personal computer 125 transmitting the near-field speaker feed signals to the headphones 115*a* via such wireless interfaces.

Some examples of method 400 may be directed to multiple-user implementations, such as multi-player implementations. Accordingly, such examples may involve determining a second position of a second set of near-field speakers located within the reproduction environment. Such examples may involve determining, if the near-field gain is non-zero, second near-field speaker feed signals based at least in part on the near-field gain and the second position of the second set of near-field speakers. The second near-field speaker feed signals may be different from the first near-field speaker feed signals. Some such implementations may involve determining a second orientation of the second set of near-field speakers. Determining the second near-field speaker feed signals may be based, at least in part, on the second orientation.

Referring to the example of FIG. 1, some such examples may involve determining the location and orientation of the head of the player 110*b*, the location and orientation of the headphones 115*b*, etc. Some implementations may involve determining the location of the origin of the coordinate system 109" and the orientation of the coordinate system 109" relative to the coordinate system 109, and making a coordinate transformation between the coordinate system 109" and the coordinate system 109.

Some implementations may involve receiving an indication of a user interaction and generating interaction audio data corresponding with the user interaction. Some such implementations may involve generating near-field speaker feed signals based on the interaction audio data. For example, in a gaming context a user interaction may involve receiving an indication that a player is interacting with a user interface as part of a game. The player may, for example, be shooting a gun. In some instances, the user interface may provide an indication that the player is walking or otherwise moving in a physical or virtual space, throwing an object, etc.

A device, such as a game server or a local device (e.g., the personal computer 125 described above), may receive this indication of a user interaction from a user interface of a device with which the player is interacting. The device may generate interaction audio data, such as a gun sound, corresponding with the user interaction. The device may generate one or more sets of near-field speaker feed signals based on the interaction audio data and may provide the near-field speaker feed signals to one or more sets of near-field speakers that are being used by players of the game.

In some such examples, the device may generate one or more sets of far-field speaker feed signals based on the interaction audio data and may provide the far-field speaker feed signals to room speakers of the reproduction environment. For example, the device may generate far-field speaker feed signals that simulate a reverberation of a player's footsteps, a reverberation of a gun sound, a reverberation of a sound caused by a thrown object, etc.

According to some implementations, one or more sets of near-field speakers may reside in headphones. It is desirable that the headphones allow the wearer to hear sounds produced by the room speakers. However, the headphones will generally occlude at least some of the sounds produced by the room speakers. Each type of headphone may have a characteristic type of occlusion, which may correspond with the materials from which the headphones are made.

The characteristic type of occlusion for a type of headphones may be represented by what will be referred to herein as "audio occlusion data." According to some examples, the audio occlusion data for each of a plurality of headphone types may be stored in a data structure that is accessible by a control system such as the control system shown in FIG. 3. In some examples, the data structure may store audio occlusion data and a headphone code for each of a plurality of headphone types. Each headphone code may correspond with a particular model of headphones. The characteristic type of occlusion for some headphones may be frequency-dependent and therefore the corresponding audio occlusion data may be frequency-dependent. In some such examples, the audio occlusion data for a particular type of headphones may include occlusion data for each of a plurality of frequency bands.

According to some implementations in which the first set of near-field speakers resides in first headphones, method 400 may involve determining audio occlusion data for the first headphones. For example, such implementations may involve accessing a data structure in which audio occlusion data are stored. Some such implementations may involve searching the data structure via a headphone code that corresponds to the first headphones.

Some such implementations also may involve equalizing the room speaker feed signals based, at least in part, on the audio occlusion data. For example, if the audio occlusion data indicates that the first headphones will attenuate audio data in a particular frequency band (e.g., a high-frequency band) by 3 dB, some such implementations may involve boosting the room speaker feed signals by approximately 3 dB in a corresponding frequency band.

In some instances there may be multiple users or players in a reproduction environment, each of whom is wearing different headphones. Each of the headphones may have different characteristic types of occlusion and therefore different audio occlusion data. Some implementations may be capable of determining an "average target equalization" for the room speaker feed signals, based on multiple instances of audio occlusion data. For example, if the audio occlusion data indicates that a first set of headphones will attenuate audio data in a particular frequency band (e.g., a high-frequency band) by 3 dB, a second set of headphones will attenuate audio data in the frequency band by 10 dB and a third set of headphones will attenuate audio data in the frequency band by 6 dB, some such implementations may involve boosting the room speaker feed signals for that frequency band by 6 dB, according to an average target equalization that takes into account the audio occlusion data for each of the three sets of headphones.

Some such implementations may involve equalizing at least some of near-field speaker feed signals based, at least in part, on the average target equalization. For example, the near-field speaker feed signals for the first set of headphones described in the preceding paragraph may be attenuated by 3 dB for the frequency band in view of the average target equalization, because the average target equalization would result in boosting the room speaker feed signals for that frequency band by 3 dB more than necessary for the occlusion caused by the first set of headphones.

Figure 5:
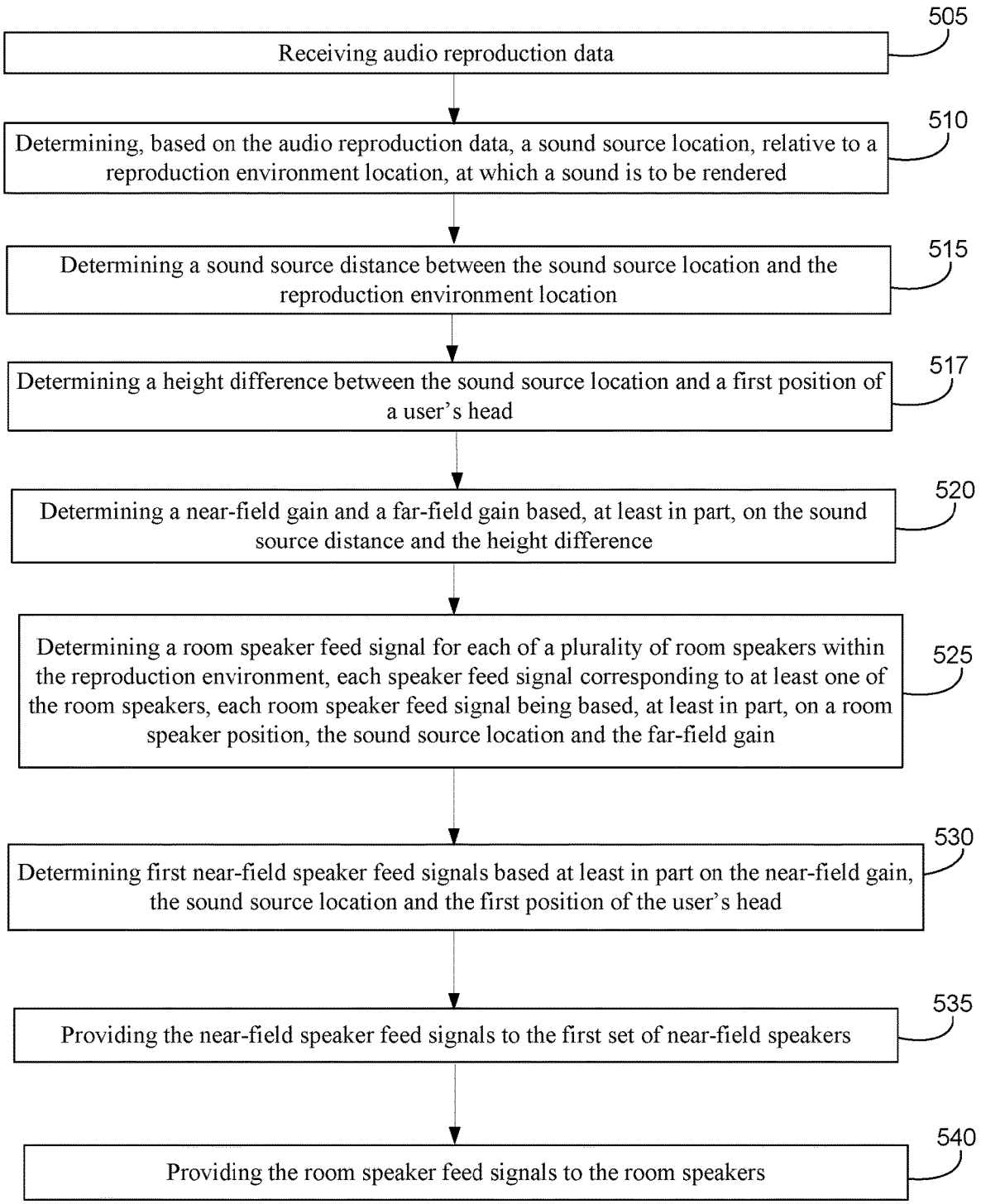
FIG. 5 is a flow diagram that outlines blocks of a method according to an alternative implementation.

FIG. 5 is a flow diagram that outlines blocks of a method according to an alternative implementation. The method may, in some instances, be performed by the apparatus of FIG. 3 or by another type of apparatus disclosed herein. In some examples, the blocks of method 500 may be implemented via software stored on one or more non-transitory media. The blocks of method 500, like other methods described herein, are not necessarily performed in the order indicated. Moreover, such methods may include more or fewer blocks than shown and/or described.

In this implementation, block 505 involves receiving audio reproduction data. According to some examples, the audio reproduction data may include audio objects. The audio objects may include audio data and associated metadata. The metadata may, for example, include data indicating the position, size and/or trajectory of an audio object in a three-dimensional space, etc. Alternatively, or additionally, the audio reproduction data may include channel-based audio data.

According to this example, block 510 involves determining, based on the audio reproduction data, a sound source location, relative to a reproduction environment location, at which a sound is to be rendered. In some implementations, the audio reproduction data may include one or more audio objects. The sound source location may correspond with an audio object location. The reproduction environment location may correspond to the origin of a coordinate system, such as the coordinate system 109 shown in FIG. 1. The reproduction environment location may, in some examples, correspond with the center of the reproduction environment.

Here, block 515 involves determining a sound source distance between the sound source location and the reproduction environment location. For example, the reproduction environment location may be the origin of a coordinate system. In such instances, the sound source distance may correspond with a radius from the origin of the coordinate system to the sound source location. In some examples, the reproduction environment location may correspond with a center of the reproduction environment. For implementations in which the audio reproduction data includes audio objects, the sound source location may correspond with an audio object location. In some such instances, the sound source distance may correspond with a radius from the origin of the coordinate system to the audio object location.

According to this example, block 517 involves determining a height difference between the sound source location and a first position of a user's head. According to some examples, the height of the user's head may be measured or estimated, e.g., according to image data from cameras in a reproduction environment. The position—and in some instances the orientation—of a person's head may be determined from the image data. According to some implementations, the position and orientation of a set of near-field speakers may be inferred according to the position and orientation of a player's head. In some examples, the location and orientation of headsets, headphones and/or other devices in which near-field speakers may be deployed may be determined directly according to image data from the cameras. Alternatively, or additionally, in some implementations headsets, headphones, or other wearable gear may include one or more inertial sensor devices that are configured for providing information regarding player head orientation and/or player location. Referring to the example of FIG. 1, block 517 may involve determining the position and orientation of the head of the player 110*a*, the location and orientation of the headphones 115*a*, etc. In some implementations, block 517 may involve determining the location of the origin of the coordinate system 109' and the orientation of the coordinate system 109' relative to the coordinate system 109.

According to some examples, block 517 may involve determining the positions—and possibly the orientations—of multiple users' heads. In some such examples, block 517 may involve determining a height of multiple users' heads. According to some implementations, block 517 may involve determining a height difference between the sound source location and an average height of multiple users' or players' heads. However, in order to simplify calculation and decrease computational overhead, in some implementations the height of the user's head, or an average height of multiple users' heads, may be assumed to be constant.

In this example, block 520 involves determining a near-field gain and a far-field gain based, at least in part, on the sound source distance and the height difference. Some detailed examples are provided below. According to some examples, block 520 (or another block of the method 500) may involve differentiating near-field sound sources and far-field sound sources in the audio reproduction data. Block 520 may, for example, involve differentiating the near-field sound sources and the far-field sound sources according to a distance between the sound source location and the location of the reproduction environment, such as an origin of a coordinate system. For example, block 520 may involve determining whether a location at which a sound source is to be rendered is within a predetermined first radius of a point, such as a center point, of the reproduction environment.

According to some examples, block 520 may involve determining that a sound source is to be rendered in a transitional zone between the near field and the far field. The transitional zone may, for example, correspond to a zone outside of the first radius but less than or equal to a predetermined second radius of a point, such as a center point, of the reproduction environment. In some implementations, sound sources may include metadata indicating whether a sound source is a near-field sound source, a far-field sound source or in a transitional zone between the near field and the far field. Some examples are described above with reference to FIG. 2.

In some examples, the far-field gain may be determined as follows:

$$FFgain=(1-G1)*G2+G1 \quad \text{(Equation 2)}$$

In Equation 2, FFgain represents the far-field gain. According to some implementations, G1 and G2 may be determined as follows:

$$G1=0.5*(1+\tan h(2*(R-2.5))) \quad \text{(Equation 3)}$$

$$G2=\sin(\text{magnitude}(Z)) \quad \text{(Equation 4)}$$

In Equation 3, R represents the sound source distance between the sound source location and the reproduction environment location. For example, R may represent a radius from the origin of a coordinate system, such as the coordinate system 109 shown in FIG. 1, to the sound source location. In Equation 4, Z represents the height of a user's head. Z may be determined in various ways according to the particular implementation, as noted above.

In this example, block 525 involves determining a room speaker feed signal for each of a plurality of room speakers within the reproduction environment. According to some examples, the far-field gain may be non-zero if the sound source location is at least a far-field threshold distance from the reproduction environment location. According to this example, each speaker feed signal corresponds to at least one of the room speakers. Here, each room speaker feed signal is based, at least in part, on a room speaker position, the sound source location and the far-field gain.

According to some examples, block 525 may involve rendering far-field audio objects into a first plurality of speaker feed signals for room speakers of a reproduction environment. Each speaker feed signal may, for example, correspond to at least one of the room speakers. According to some such implementations, block 525 may involve computing audio gains and speaker feed signals for the reproduction environment based on received audio data and associated metadata. Such audio gains and speaker feed signals may, for example, be computed according to an amplitude panning process, such as one of the amplitude panning processes described above. In some implementations, a global distance attenuation factor (such as 1/R) may be applied for sound source locations that are at least a threshold distance from the reproduction environment location, such as for sound source locations that are outside of the reproduction environment.

In the example shown in FIG. 5, block 530 involves determining first near-field speaker feed signals based at least in part on the near-field gain, the sound source location and the first position of the user's head. According to some examples, block 530 (and/or block 520) may be performed as described above with reference to block 435 of FIG. 4. In some such examples, block 530 (and/or block 520) may involve determining near-field speaker feed signals based on the position of the user's head. The position of the user's head may correspond to a position of a set of near-field speakers located within the reproduction environment.

According to some such examples, block 530 (and/or block 520) may involve determining near-field speaker feed signals based on the distance from the user's head to a reference reproduction environment location, such as the center of the reproduction environment. In some instances, block 530 (and/or block 520) may involve determining near-field speaker feed signals based on a coordinate transformation between a coordinate system having its origin in a reproduction environment location (such as the coordinate system 109 shown in FIG. 1) and a coordinate system associated with a user's head or a set of near-field speakers (such as the coordinate system 109' or 109" shown in FIG. 1). For example, the gains may first be computed according to the reproduction environment location and may later be adjusted based on the distance between the user's head and/or the set of near-field speakers. In some such implementations, a local distance attenuation factor (such as 1/r, wherein r corresponds with the distance from the user's head to a reference reproduction environment location) may be applied to near-field speaker feed signals that have been computed according to the reference reproduction environment location. In some examples, block 530 (and/or block 520) may involve determining near-field speaker feed signals based on the orientation of the user's head. The orientation of the user's head may correspond to the orientation of a set of near-field speakers located within the reproduction environment. In some such examples, block 530 may involve a binaural rendering of audio data based on the position and/or orientation of a user's head.

In some implementations, the determination of near-field speaker feed signals may involve applying a crossover filter or a high-pass filter to the received audio reproduction data. In one such example, the cut-off frequency of a crossover filter may be 60 Hz. However, this is merely an example. Other implementations may apply a different cut-off frequency. According to some examples, the cut-off frequency may be selected according to one or more characteristics (such as frequency response) of one or more room speakers and/or near-field speakers. Some implementations may involve determining the near-field speaker feed signals based on a high-frequency component of the audio reproduction data that is output from the crossover filter or high-pass filter. In some such examples, block 530 may involve a binaural rendering of the high-frequency component based on the position and/or orientation of a user's head.

According to some examples, the determination of far-field speaker feed signals also may involve applying a crossover filter to the received audio reproduction data. Accordingly, some implementations may involve determining a low-frequency component and a high-frequency component of the audio reproduction data. In some such implementations, determining the far-field speaker feed signals may involve applying the far-field gain determined in block 520 to a sum of the low-frequency component and the high-frequency component.

According to some implementations in which the first set of near-field speakers resides in first headphones, method 500 may involve determining audio occlusion data for the first headphones. For example, such implementations may involve accessing a data structure in which audio occlusion data are stored. Some such implementations may involve searching the data structure via a headphone code that corresponds to the first headphones.

Some such implementations also may involve equalizing the room speaker feed signals based, at least in part, on the audio occlusion data, e.g., as described above. In some instances there may be multiple users or players in a reproduction environment, each of whom is wearing different headphones. Each of the headphones may have different audio occlusion data. Some implementations may be capable of determining an "average target equalization" for the room speaker feed signals, based on multiple instances of audio occlusion data, e.g., as described above. Some such implementations may involve equalizing at least some of near-field speaker feed signals based, at least in part, on the average target equalization, e.g., as described above.

In the example shown in FIG. 5, block 535 involves providing the near-field speaker feed signals to the first set of near-field speakers and block 540 involves providing the room speaker feed signals to the room speakers.

Various modifications to the implementations described in this disclosure may be readily apparent to those having ordinary skill in the art. For example, some scenarios being investigated by the Moving Picture Experts Group (MPEG) are six degrees of freedom virtual reality (6 DOF) which is exploring how a user can takes a "free view point and orientation in the virtual world" employing "self-motion" induced by an input controller or sensors or the like. (See 118th MPEG Hobart(TAS), Australia, 3-7 Apr. 2017, Meeting Report at Page 3) MPEG is exploring from an audio perspective scenarios which are very close to a gaming scenario where sound elements are typically stored as sound objects. In these scenarios, a user can move through a scene with 6 DOF where a renderer handles the appropriately processed sounds dependent on a position and orientation. Such 6 DOF employ pitch, yaw and roll in a Cartesian coordinate system and virtual sound sources populate the environment.

Sources may include rich metadata (e.g. sound directivity in addition to position), rendering of sound sources as well as "Dry" sound sources (e.g., distance, velocity treatment and environmental acoustic treatment, such as reverberation).

As described in in MPEG's technical report on Immersive media, VR and non-VR gaming applications sounds are typically stored locally in an uncompressed or weakly encoded form which might be exploited by the MPEG-H 3D Audio, for example, if certain sounds are delivered from a far end or are streamed from a server. Accordingly, rendering could be critical in terms of latency and far end sounds and local sounds would have to be rendered simultaneously by the audio renderer of the game.

Accordingly, MPEG is seeking a solution to deliver sound elements from an audio decoder (e.g., MPEG-H 3D) by means of an output interface to an audio renderer of the game.

Some innovative aspects of the present disclosure may be implemented as a solution to spatial alignment in a virtual environment. In particular, some innovative aspects of this disclosure could be implemented to support spatial alignment of audio objects in a 360-degree video. In one example supporting spatial alignment of audio objects with media played out in a virtual environment. In another example supporting the spatial alignment of an audio object from another user with video representation of that other user in the virtual environment.

The general principles defined herein may be applied to other implementations without departing from the scope of this disclosure. Thus, the claims are not intended to be limited to the implementations shown herein, but are to be accorded the widest scope consistent with this disclosure, the principles and the novel features disclosed herein.

The invention claimed is:

1. An audio processing method, comprising:

receiving audio reproduction data;

determining, based on the audio reproduction data, a sound source location, relative to a reproduction environment location, at which a sound is to be rendered;

determining a sound source distance between the sound source location and the reproduction environment location;

determining a near-field gain and a far-field gain based, at least in part, on the sound source distance;

determining, if the far-field gain is non-zero, a room speaker feed signal for each of a plurality of room speakers within the reproduction environment, each speaker feed signal corresponding to at least one of the room speakers, each room speaker feed signal being based, at least in part, on a room speaker position, the sound source location and the far-field gain;

determining a first position corresponding to a first set of near-field speakers located within the reproduction environment;

determining, if the near-field gain is non-zero, first near-field speaker feed signals based at least in part on the near-field gain, the sound source location and the first position of the first set of near-field speakers; and providing the near-field speaker feed signals to the first set of near-field speakers, providing the room speaker feed signals to the room speakers, or providing both the near-field speaker feed signals to the first set of near-field speakers and the room speaker feed signals to the room speakers.

2. The method of claim 1, further comprising determining a first orientation of the first set of near-field speakers, wherein determining the near-field speaker feed signals is based, at least in part, on the orientation of the first set of near-field speakers.

3. The method of claim 2, wherein the first position corresponds to a first position of a user's head and wherein the first orientation corresponds to a first orientation of a user's head.

4. The method of claim 1, wherein the audio reproduction data includes one or more audio objects and wherein the sound source location comprises an audio object location.

5. The method of claim 4, wherein the reproduction environment location corresponds with a center of the reproduction environment.

6. The method of claim 1, wherein the far-field gain is non-zero if the sound source location is at least a far-field threshold distance from the reproduction environment location.

7. The method of claim 1, wherein the first set of near-field speakers is disposed within first headphones, further comprising determining audio occlusion data for the first headphones.

8. The method of claim 7, further comprising equalizing the room speaker feed signals based, at least in part, on the audio occlusion data.

9. The method of claim 7, further comprising:

determining an average target equalization for the room speakers; and equalizing the first near-field speaker feed signals based, at least in part, on the average target equalization.

10. The method of claim 1, further comprising:

determining a second position of a second set of near-field speakers located within the reproduction environment;

determining, if the near-field gain is non-zero, second near-field speaker feed signals based at least in part on the near-field gain and the second position of the second set of near-field speakers, the second near-field speaker feed signals being different from the first near-field speaker feed signals.

11. The method of claim 10, further comprising determining a second orientation of the second set of near-field speakers, wherein determining the second near-field speaker feed signals is based, at least in part, on the second orientation.

12. The method of claim 11, further comprising:

receiving an indication of a user interaction;

generating interaction audio data corresponding with the user interaction, the interaction audio data including an interaction audio data position; and generating near-field speaker feed signals based on the interaction audio data.

13. The method of 12, further comprising transmitting the near-field speaker feed signals to the first set of near-field speakers via a wireless interface.

14. One or more non-transitory media having software stored thereon, the software including instructions for performing the method of claim 1.

15. An apparatus configured for performing the method of claim 1.

* * * * *